US007316600B1

(12) United States Patent
Pilkington

(10) Patent No.: US 7,316,600 B1
(45) Date of Patent: Jan. 8, 2008

(54) METAL WORKING METHOD TO REDUCE THERMAL DAMAGE

(75) Inventor: Mark Iain Pilkington, Camby, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 11/694,090

(22) Filed: Mar. 30, 2007

(51) Int. Cl.

| | |
|---|---|
| ***B24B 49/00*** | (2006.01) |
| ***B24B 51/00*** | (2006.01) |
| ***B24B 1/00*** | (2006.01) |
| ***B24B 7/19*** | (2006.01) |
| ***B24B 7/30*** | (2006.01) |
| ***B24B 7/00*** | (2006.01) |
| ***B24B 9/00*** | (2006.01) |
| ***B24B 5/00*** | (2006.01) |

(52) U.S. Cl. ..... 451/5; 451/28; 451/177; 451/287

(58) Field of Classification Search ..... 451/5, 451/28, 177, 287, 548

See application file for complete search history.

(56) References Cited

U.S. PATENT DOCUMENTS

| | | | | |
|---|---|---|---|---|
| 927,450 | A | 7/1909 | Chemack | |
| 1,914,413 | A | 6/1933 | Elbert | |
| 2,231,900 | A * | 2/1941 | Geoffrion | 451/58 |
| 2,232,387 | A | 2/1941 | Hardy | |
| 2,453,136 | A | 11/1948 | Karweit | |
| 2,922,257 | A | 1/1960 | Else | |
| 3,045,399 | A | 7/1962 | Sloan | |
| 3,680,268 | A * | 8/1972 | Lorton | 451/380 |
| 4,076,007 | A | 2/1978 | Redlin | |
| 4,094,102 | A | 6/1978 | Lauze et al. | |
| 4,994,280 | A * | 2/1991 | Kochinsky | 424/672 |
| 5,175,964 | A | 1/1993 | Girndt | |
| 5,355,635 | A | 10/1994 | Sasaki et al. | |
| 5,540,614 | A * | 7/1996 | P oschl | 451/165 |
| 5,791,223 | A | 8/1998 | Lanzer | |
| 6,736,703 | B2 | 5/2004 | Osada et al. | |
| 7,059,229 | B2 | 6/2006 | Lanzer | |
| 2002/0083812 | A1 | 7/2002 | Lanzer | |
| 2005/0032469 | A1 * | 2/2005 | Duescher | 451/548 |

* cited by examiner

*Primary Examiner*—Joseph J. Hail, III
*Assistant Examiner*—Alvin J Grant
(74) *Attorney, Agent, or Firm*—Dickinson Wright PLLC

(57) ABSTRACT

A method for grinding a feature in a work-piece is set forth which includes the step of rotating a grinding wheel about a first axis. The method also includes the step of traversing the rotating grinding wheel and a work-piece relative to one another along a second axis that is transverse to the first axis to form a feature in the work-piece. The method also includes the step of oscillating the rotating grinding wheel and the work-piece toward and away from one another in first and second opposite directions transverse to both of the first and second axes during said traversing step. As a result, the rotating grinding wheel and the work-piece are moving relative to one another along both of the second axis and one of the first and second opposite directions during the traversing step to reduce burning of the work-piece.

20 Claims, 5 Drawing Sheets

METAL WORKING METHOD TO REDUCE THERMAL DAMAGE

BACKGROUND OF THE INVENTION

1. Field of the Invention

The invention relates to a method for forming a feature in a work-piece such as by grinding a slot.

2. Description of Related Prior Art

U.S. Pat. No. 2,922,257 discloses a metal cutting and grinding apparatus. Two structures are mounted for movement along a beam 1, a traversing carriage 25 and a driving unit 8. The driving unit 8 controls a grinding wheel 19 to rotate and make a cut 31 in a plate 24. The driving unit 8 is moved along the plate 24 by the traversing carriage 25. The traversing carriage 25 and the driving unit 8 are connected to one another through a crank 28 and a connecting rod 29. In operation, the cooperative action of the crank 28 and the connecting rod 29 results in the driving unit 8 being moved back and forth in a horizontal direction relative to the traversing carriage 25 while the cut 31 is made. The traversing carriage 25 moves at a constant rate of speed and thus the driving unit 8 experiences oscillating acceleration in the horizontal/cutting direction during formation of the cut 31.

SUMMARY OF THE INVENTION

A method for grinding a feature in a work-piece is set forth which includes the step of rotating a grinding wheel about a first axis. The method also includes the step of traversing the rotating grinding wheel and a work-piece relative to one another along a second axis that is transverse to the first axis to form a feature in the work-piece. The method also includes the step of oscillating the rotating grinding wheel and the work-piece toward and away from one another in first and second opposite directions transverse to both of the first and second axes during said traversing step. As a result, the rotating grinding wheel and the work-piece are moving relative to one another along both of the second axis and one of the first and second opposite directions during the traversing step to reduce burning of the work-piece.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
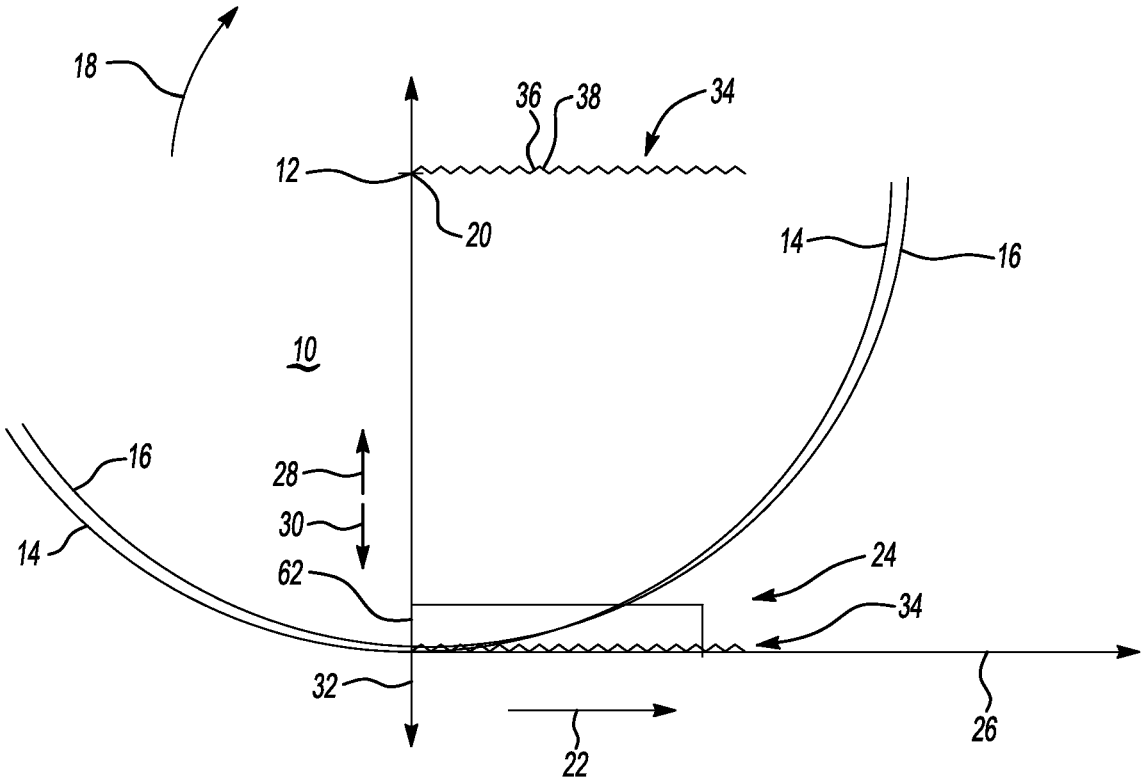
FIG. 1 is a schematic diagram of a first exemplary embodiment of the invention.

A plurality of different embodiments of the invention are shown in the Figures of the application. Similar features are shown in the various embodiments of the invention. Similar features have been numbered with a common reference numeral and have been differentiated by an alphabetic designation. Also, to enhance consistency, features in any particular drawing share the same alphabetic designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

FIG. 1 corresponds to a first exemplary embodiment of the invention and is a simplified schematic diagram showing a grinding wheel 10 with a center 12. FIG. 1 shows the grinding wheel 10 in two positions. A line 14 represents the periphery of the grinding wheel 10 when the grinding wheel 10 is in a first position. A line 16 represents the periphery of the grinding wheel 10 when the grinding wheel 10 is in a second position. The relevance of the first and second positions will be discussed further below. The center 12 is marked in FIG. 1 when the grinding wheel 10 is in the first position. The center 12 is not marked when the grinding wheel 10 is in the second position.

The grinding wheel 10 is moved relative to a work-piece 24 to produce a feature in the work-piece. In the exemplary embodiment of the invention, the grinding wheel 10 can be rotated in a direction indicated by an arrow 18 about a first axis 20. The grinding wheel 10 can be rotated in the direction opposite the arrow 18. The first axis 20 extends through the center 12 of the grinding wheel 10. The grinding wheel can also be moved rectilinearly in a direction indicated by an arrow 22 along a second axis 26. The rotating grinding wheel 10 can also be oscillated during movement in the direction indicated by the arrow 22. The oscillating movement occurs in first and second opposite directions indicated by arrows 28, 30. In the first exemplary embodiment of the invention, the movement in the first and second opposite directions is rectilinear. The oscillating movement occurs along a third axis 32 that is perpendicular to both of the first and second axes 20, 26. As a result, the rotating grinding wheel 10 and the work-piece 24 are moving relative to one another along both of the second and third axes 26, 32 during movement in the direction represented by the arrow 22. The oscillating movement reduces burning of the work-piece.

In the exemplary embodiment of the invention, the work-piece 24 is held stationary and the grinding wheel 10 is moved along the axes 26, 32. In alternative embodiments of the invention, the rotating grinding wheel 10 can be held stationary and the work-piece 24 can be moved relative to the grinding wheel 10. In addition, in alternative embodiments of the invention, both the rotating grinding wheel 10 and the work-piece 24 can be moved to produce the desired feature.

Alternative embodiments of the invention can be practiced with movements that are different from the movement that is shown in the exemplary embodiment to form features that are different than a slot. The embodiments of the invention share the common feature in that grinding wheel and work-piece are moving relative to one another concurrently in a feature-forming direction as well as direction transverse to the feature forming direction. For example, in an alternative embodiment of the invention, the method could be practiced wherein the end face of a component that is narrower than the grinding wheel can be ground; such a metal-working operation would have no contact with the sides of the grinding wheel. Alternatively, the method could be practiced for grinding with a 90 degree V wheel, such as when machining a diameter and face at the same time, commonly used on stepped shafts, turbine vanes; the movement in such a metal working operation would clear the work-piece in all planes when the grinding wheel is moved away from the work-piece. Alternatively, the method could be practiced for grinding features that have only one side of the wheel in contact with the part, such as a notch.

FIG. 1 schematically shows the first embodiment of the invention wherein the oscillating movement includes moving the first axis 20 (the center 12 of the grinding wheel 10) in a saw-tooth pattern represented by a line 34. The saw-tooth line 34 is defined in a plane containing both the second and third axes 26, 32. The line 34 is shown twice, once at the center 12 and once at the bottom dead center of the grinding wheel 10. The saw-tooth line 34 represents the path of movement of the grinding wheel 10 and includes symmetrical teeth shapes such that the first axis 20 repeatedly moves along a first slope 36 in the first direction represented by the arrow 28 and a second slope 38 in the second direction represented by the arrow 30. The first slope 36 is equal to the second slope 38 in that the absolute values of the slopes 36, 38 are equal. The first and second slopes 36, 38 differ in that the first slope 36 is positive and the second slope 38 is negative. In FIG. 1, the positive slope 36 and the direction represented by the arrow 28 represent movement of the grinding wheel 10 and work-piece 24 apart from one another and the negative slope 38 and the direction represented by the arrow 30 represent movement of the grinding wheel 10 and work-piece 24 toward one another.

In the first exemplary embodiment of the invention shown in FIG. 1, the saw-tooth pattern represented by line 34 includes raising the rotating grinding wheel 10 and the positive slope 36 has a value of at least 0.667. In other words, the grinding wheel 10 moves three (3) units in the direction represented by the arrow 22 while also moving two (2) units in the direction represented by the arrow 28 during movement along the slope 36. The saw-tooth pattern represented by line 34 also includes lowering the rotating grinding wheel 10 and the negative slope 38 has an absolute value of at least 0.666. In other words, the grinding wheel 10 moves three (3) units in the direction represented by the arrow 22 while also moving two (2) units in the direction represented by the arrow 30 during movement along the slope 38. Different slopes can applied in alternative embodiments of the invention.

The first and second positions noted above relate to positions of the grinding wheel 10 when the grinding wheel 10 transitions between movement along the two slopes 36, 38. In other words, the first and second positions designate when the grinding wheel 10 and the work-piece 24 are fully engaged (first position) and when the grinding wheel 10 and the work-piece 24 are a maximum distance apart (second position). Generally, each position is a relative position in that each position is defined by the grinding wheel 10 and the work-piece 24 relative to one another. In the first exemplary embodiment of the invention, the positions are described as being associated with the grinding wheel 10 only because the work-piece 24 is stationary. In embodiments of the invention in which the grinding wheel is stationary and the work-piece is moved, the positions would be associated with the work-piece. In embodiments of the invention in which both the grinding wheel and the work-piece are moved, the positions would be associated with the grinding wheel and the work-piece.

With respect to the first exemplary embodiment of the invention, the positions define points of transition in which the grinding wheel 10 transitions between movement along the two slopes 36, 38. The first position is defined when the grinding wheel 10 transitions from movement along the slope 38 to movement along the slope 36. In the first position, the grinding wheel 10 is fully engaged with the work-piece 24 and material is being removed from the work-piece at a maximum rate. The grinding wheel 10 and the work-piece 24 are closest to one another when the grinding wheel 10 is in the first position.

When the grinding wheel moves away from the first position, material removal ceases. Material removal does not occur during movement along the slope 36. During this movement of the grinding wheel 10 from the first position, along the slope 36, the grinding wheel 10 and the work-piece can cool. To further enhance cooling, coolant can be injected on the feature being formed in the work-piece 24 and can also be applied to the grinding wheel 10.

The second position is defined when the grinding wheel 10 transitions from movement along the slope 36 to movement along the slope 38. The grinding wheel 10 and the work-piece 24 are furthest from one another when the grinding wheel 10 is in the second position. Material removal will begin substantially immediately after the grinding wheel 10 moves from the second position toward the first position. The rate of material removal will increase as the grinding wheel 10 moves closer toward the first position, reaching a maximum rate at the first position.

The first exemplary embodiment of the invention can be practiced such that the starting point of movement of the grinding wheel 10 is offset a distance along the axis 32 away from the work-piece 24 such the grinding wheel 10 is initially "plunged" down into the work-piece 24. In one or more plunges toward the work-piece 24, the movement would be along the axis 32 only, in the first and second opposite directions represented by the arrows 28, 30. This movement can be carried out until a full, desired cutting depth is reached. After the one or more plunges, the grinding wheel 10 can be moved in the manner described above. This technique has the potential to be quicker and use less grinding wheel capacity than starting the cut from a side 62 of the work-piece 24.

Figure 2:
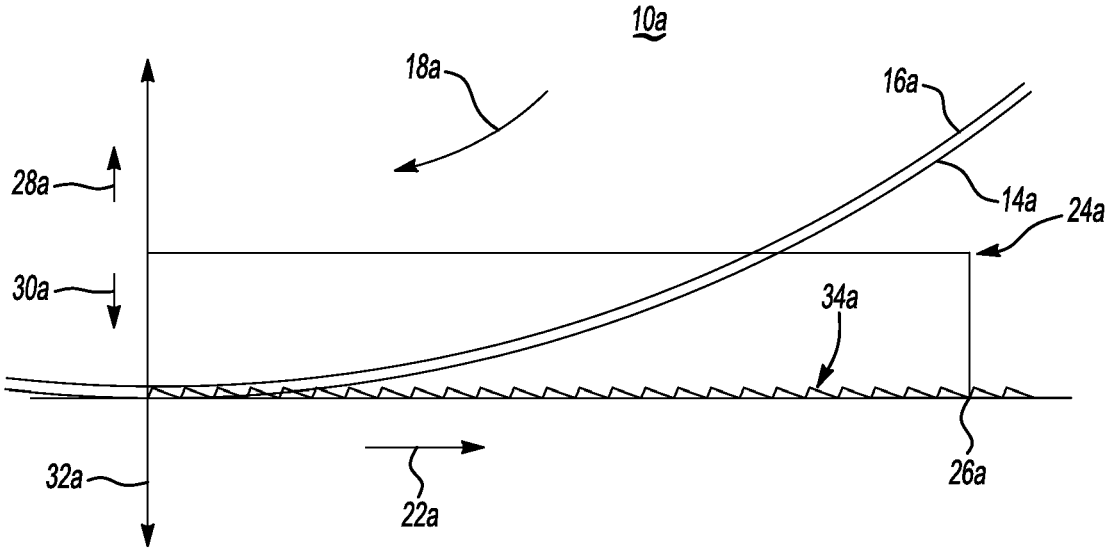
FIG. 2 is a schematic diagram of a second exemplary embodiment of the invention.

FIG. 2 corresponds to a second exemplary embodiment of the invention and is a simplified schematic diagram showing a grinding wheel 10*a*. FIG. 2 shows the grinding wheel 10*a* in two positions. A line 14*a* represents the periphery of the grinding wheel 10*a* when the grinding wheel 10*a* is in a first position. A line 16*a* represents the periphery of the grinding wheel 10*a* when the grinding wheel 10*a* is in a second position. The relevance of the first and second positions is the same as discussed above with respect to the first exemplary embodiment of the invention.

The grinding wheel 10*a* can be rotated in a direction indicated by an arrow 18*a* about a first axis (not shown) and moved rectilinearly in a direction indicated by an arrow 22*a* to form a slot in a work-piece 24*a*. Relative movement between the rotating grinding wheel 10*a* occurs along a second axis 26*a* perpendicular to the first axis, which extends through the center (not shown) of the grinding wheel 10*a*. The rotating grinding wheel 10*a* can be oscillated during movement in the direction indicated by the arrow 22*a*. The oscillating movement is rectilinear and occurs in first and second opposite directions indicated by arrows 28*a*, 30*a*. The oscillating movement occurs along a third axis 32*a* that is perpendicular to both of the first axis and the second axis 26*a*. As a result, the rotating grinding wheel 10*a* and the work-piece 24*a* are moving relative to one another along both of the second and third axes 26*a*, 32*a* during movement in the direction indicated by the arrow 22*a*. The oscillating movement reduces burning of the slot.

Figure 3:
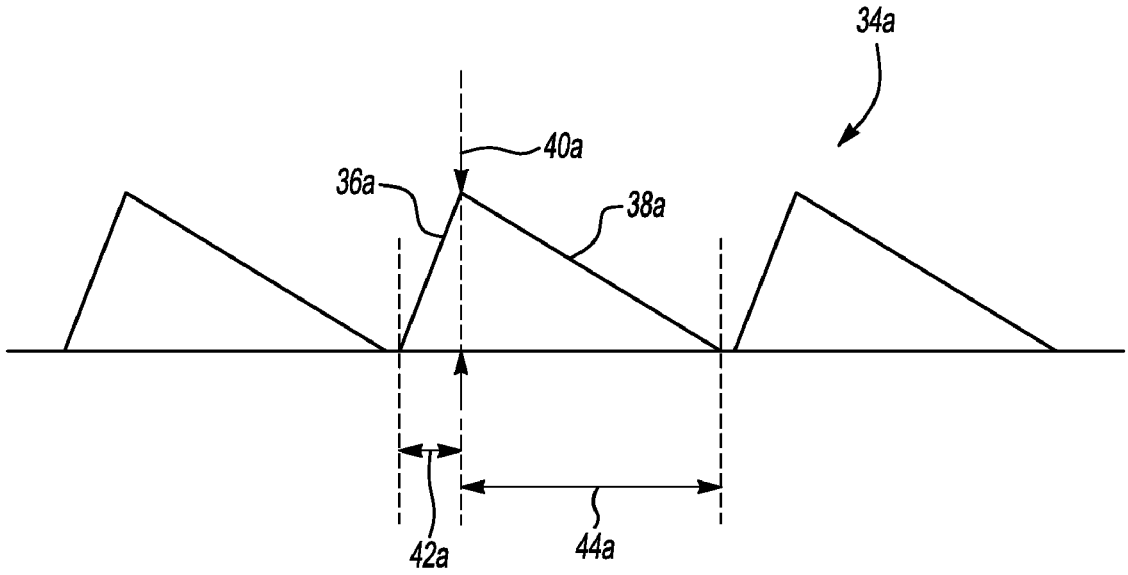
FIG. 3 is an enlarged view of a portion FIG. 2 and shows a pattern of movement of the grinding wheel.

FIGS. 2 and 3 schematically show the second embodiment of the invention wherein the oscillating movement includes moving the first axis in a saw-tooth pattern represented by a line 34*a*. The saw-tooth line 34*a* is defined in a plane containing both the second and third axes 26*a*, 32*a*. The saw-tooth line 34*a* represents the path of movement of the grinding wheel 10*a* and includes asymmetrical teeth such that the first axis repeatedly moves along a first slope 36*a* in the first direction 28*a* and a second slope 38*a* in the second direction 30*a*. The first slope 36*a* is not equal to the second slope 38*a* in that the absolute values of the slopes 36*a*, 38*a* are different. The first and second slopes 36*a*, 38*a* differ in absolute value and also in that the first slope 36*a* is positive and the second slope 38*a* is negative. In FIGS. 2 and 3, the positive slope 36*a* and the direction 28*a* represent movement of the grinding wheel 10*a* and work-piece 24*a* apart from one another and the negative slope 38*a* and the direction 30*a* represent movement of the grinding wheel 10*a* and work-piece 24*a* toward one another.

The first two exemplary embodiments of the invention set forth a saw-tooth pattern for moving the grinding wheel 10. Alternative embodiments of the invention can include patterns that are not saw-tooth. For example, the grinding wheel can be moved in a pattern defined without relatively abrupt transition points, such as a sinusoidal wave form.

Referring again to the second exemplary embodiment of the invention, the operating conditions that flow from the difference in the absolute values of the slopes 36*a*, 38*a* is that the speed of movement along the third axis 32*a* of the grinding wheel 10*a* varies during movement in the direction indicated by the arrow 22*a*, if the speed of movement along the axis 26*a* is constant. The speed of movement in the first direction indicated by the arrow 28*a* is different than the speed of movement in the second direction indicated by the arrow 30*a*. In the second exemplary embodiment of the invention, the rotating grinding wheel 10*a* is raised in the first direction indicated by the arrow 28*a* away from the work-piece 24*a* at a first speed and lowered in the second direction indicated by the arrow 30*a* toward the work-piece 24*a* at a second speed that is less than the first speed. In alternative embodiments of the invention, the speed of movement in the feature-forming direction, such as along the axis 26*a*, can be varied while the speed of movement transverse to the feature forming direction can be held constant.

In the second exemplary embodiment of the invention shown in FIGS. 2 and 3, the saw-tooth pattern represented by line 34*a* includes moving the rotating grinding wheel 10*a* away from the work-piece 24*a* to a tip or peak 40*a* along the third axis 32*a* over a distance represented by the line 42*a* along the second axis 26*a*. The exemplary positive slope 36*a* has an absolute value of at least two (2). In other words, the distance between the second axis 26*a* and the tip 40*a* is twice the value of the distance represented by the line 42*a*. For example, the distance between the second axis 26*a* and the tip 40*a* can be 1.0 millimeter and the distance represented by the line 42*a* can be 0.5 millimeter. The saw-tooth pattern represented by line 34*a* also includes lowering the rotating grinding wheel 10*a* the distance between the second axis 26*a* and the tip 40*a* along the third axis 32*a* over a distance represented by the line 44*a* along the second axis 26*a*. The exemplary negative slope 36*a* has an absolute value of at least 0.333. In other words, the distance between the second axis 26*a* and the tip 40*a* is one-third the value of the distance represented by the line 44*a*. For example, the distance between the second axis 26*a* and the tip 40*a* can be 1.0 millimeter and the distance represented by the line 44*a* can be 3.0 millimeters. Alternative embodiments of the invention can be practiced wherein the raising slope, such as slope 36*a*, has a smaller absolute value than the lowering slope 38*a*. Also, alternative embodiments of the invention can be practiced wherein the absolute values of the raising and lowering slopes are different than the values suggested by the first and second exemplary embodiments of the invention.

Figure 4:
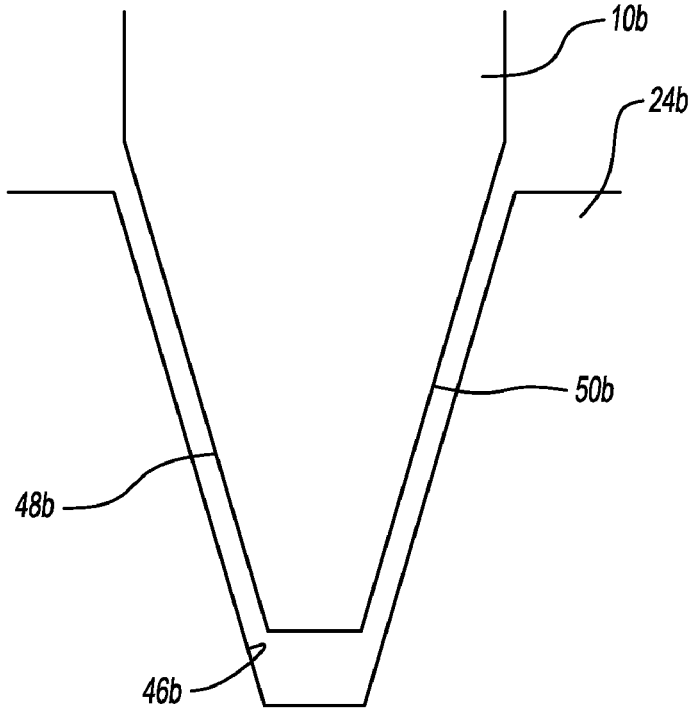
FIG. 4 is a cross-sectional detail view of a grinding wheel that can be used in practicing the invention.

The oscillating movement by either the grinding wheel, the work-piece, or both results in the intermittent separation between the rotating grinding wheel and the work-piece. The separation occurs along the third axis in the first and second exemplary embodiments of the invention. Despite the relatively complex movement, the inventive method can be practiced to form a straight slot of substantially constant depth. The temporary or intermittent separation reduces and/or eliminates burning because the grinding wheel and work-piece are not frictionally contacting one another and because cooling or cutting fluid can be injected into the gap between the grinding wheel and work-piece. FIG. 4 shows a grinding wheel 10*b* that can used in practicing the invention that further reduces and/or eliminates burning. FIG. 4 is a schematic cross-section showing a grinding wheel 10*b* disposed in a slot 46*b*. The grinding wheel 10*b* is formed with a dual-chamfered profile, having tapered walls 48*b* and 50*b*. The tapered walls 48*b*, 50*b* permit complete and immediate separation between the grinding wheel 10*b* and the work-piece 24*b* when the grinding wheel 10*b* and the work-piece 24*b* are separated from one another, such as along the slope 36 of the first exemplary embodiment or the slope 36*a* of the second exemplary embodiment.

Figure 5:
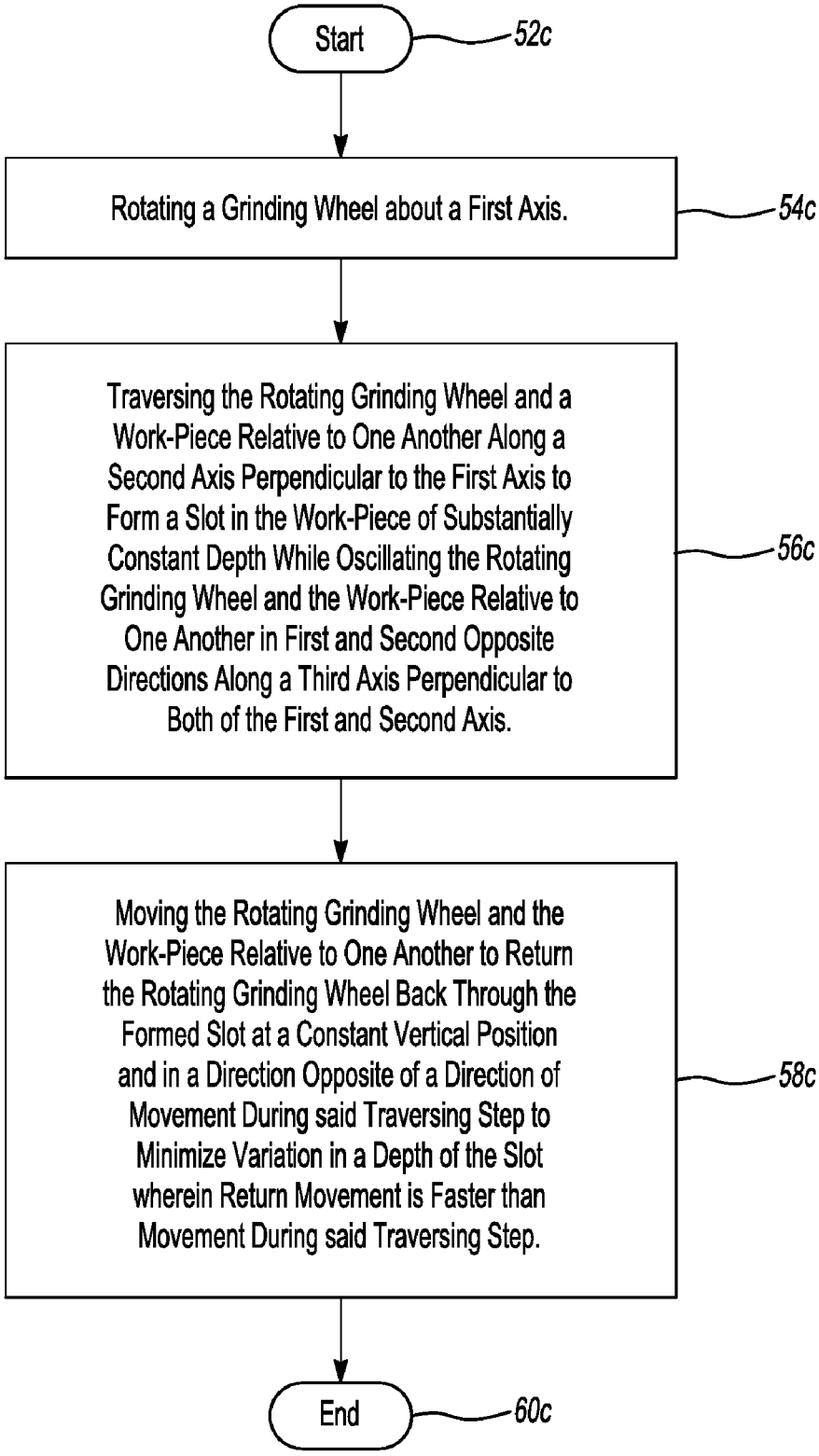
FIG. 5 is a simplified flow diagram.

FIG. 5 is a simplified flow diagram of a process for practicing the invention. The process starts at step 52*c*. At step 54*c*, a grinding wheel is rotated about a first axis. Exemplary structures for performing step 54*c* have been shown in the first, second and third embodiments of the invention. At step 56*c*, the rotating grinding wheel and a work-piece are traversed relative to one another along a second axis perpendicular to the first axis to form a slot in the work-piece of substantially constant depth while also being oscillated with respect to one another in first and second opposite directions along a third axis perpendicular to both of the first and second axes. Exemplary structures for performing step 56*c* have been shown in the first, second and third embodiments of the invention. At step 58*c*, the rotating grinding wheel and the work-piece are moved relative to one another to return the rotating grinding wheel back through the formed slot. The grinding wheel is moved at a constant vertical position and in a direction opposite of a direction of movement during the initial traversing step. Step 58*c* can be desirable to eliminate any "ripple" that may exist in the slot. After step 58*c*, the bottom of the slot is flat and the depth of the slot is constant along its length. The movement carried out in step 58*c* can be carried out at a higher speed than the speed of movement during the initial traversing step. In practice, step 58*c* can serve the dual purposes of finishing the slot and also returning the grinding wheel to a starting position. The process ends at step 60*c*.

Figure 6:
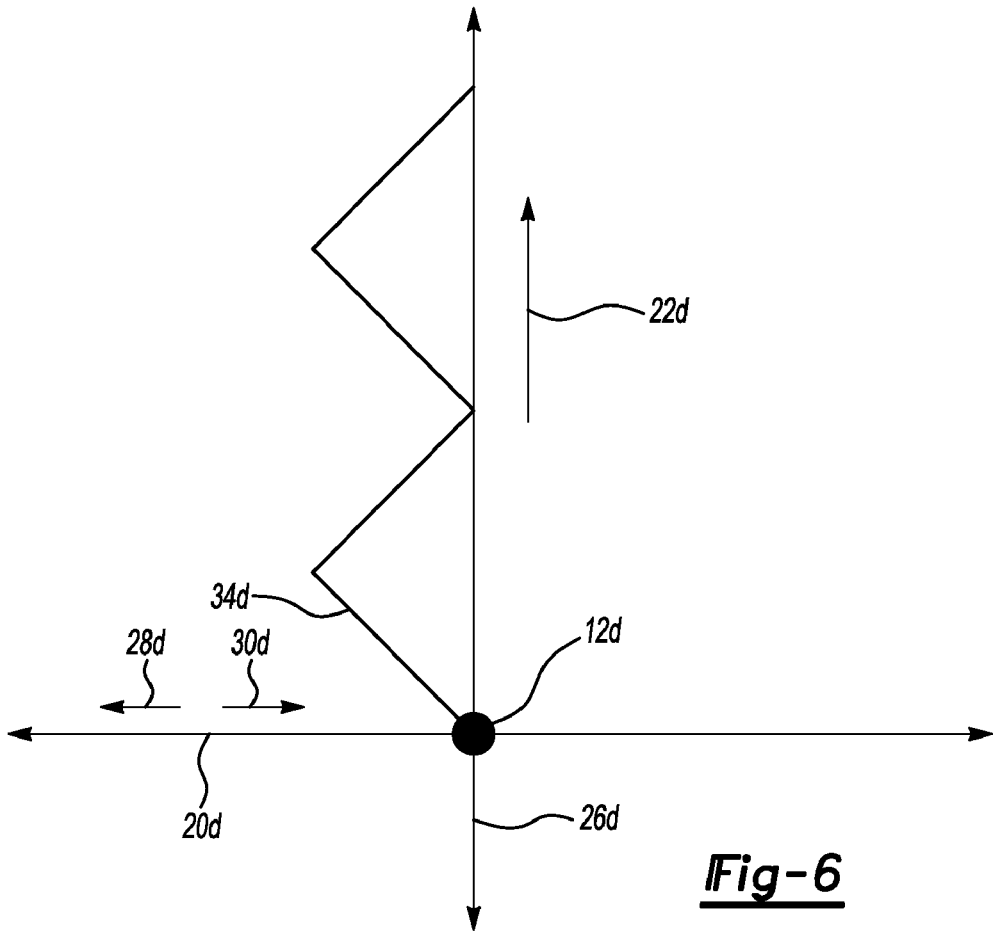
FIG. 6 is schematic view of a third embodiment of the invention wherein movement is three-dimensional and rectilinear.

In the first and second exemplary embodiments of the invention, the movement of the grinding wheels 10 and 10*a*, respectively, is planar (two dimensional) and oscillating movement proceeds along an axis that is perpendicular to the axis of the feature-forming, grinding stroke. However, alternative embodiments of the invention can be practiced wherein the oscillating movement of the grinding wheel is more complex. FIG. 6 shows an alternative embodiment of the invention in which a center 12*d* of a grinding wheel is moved along the axis 26*d* in the direction of arrow 22*d* and also moved in a first and second directions represented by arrows 28*d*, 30*d* that are parallel to the axis 20*d*. In contrast, the first and second directions represented by arrows 28, 30 in the first exemplary embodiment are perpendicular to the first axis 20. The pattern of movement of the center 12*d* in FIG. 6 is shown by line 34*d*. The movement represented by line 34*d* can be combined with the movement represented by the line 34 of the first embodiment of the invention or the line 34*a* of the second embodiment of the invention. The lines 34 and 34*a* extend in a plane that is perpendicular to the plane in which the line 34*d* extends. Thus, if the movement of lines 34 and 34*d* are combined, for example, the grinding wheel will move along a three dimensional path.

Figure 7:
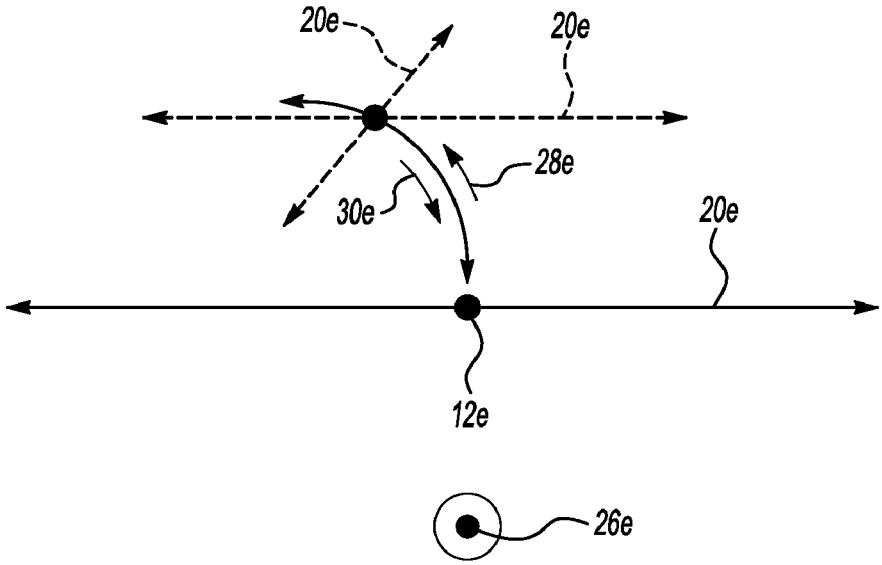
FIG. 7 is schematic view of a fourth embodiment of the invention wherein movement is three-dimensional and arcuate.

FIG. 7 shows another embodiment of the invention wherein a center 12*e* of a grinding wheel is moved along an arcuate path during oscillating movement. The center 12*e* moves in a first and second opposite directions represented by arrows 28*e*, 30*e* during oscillating movement. FIG. 7 also shows that the orientation of the axis 20*e* of rotation of the grinding wheel can vary in alternative embodiments of the invention. The orientation of the axis 20*e* shown in solid line represents the orientation of the axis 20*e* when the grinding wheel is in the first position. Two alternative orientations of the axis 20*e* in the second position are shown in phantom. In a first example, the orientation of the axis 20*e* in the second position is parallel to the orientation of the axis 20*e* in the first position. In a second example, the orientation of the axis 20*e* in the second position is transverse or oblique to the orientation of the axis 20*e* in the first position.

Figure 8:
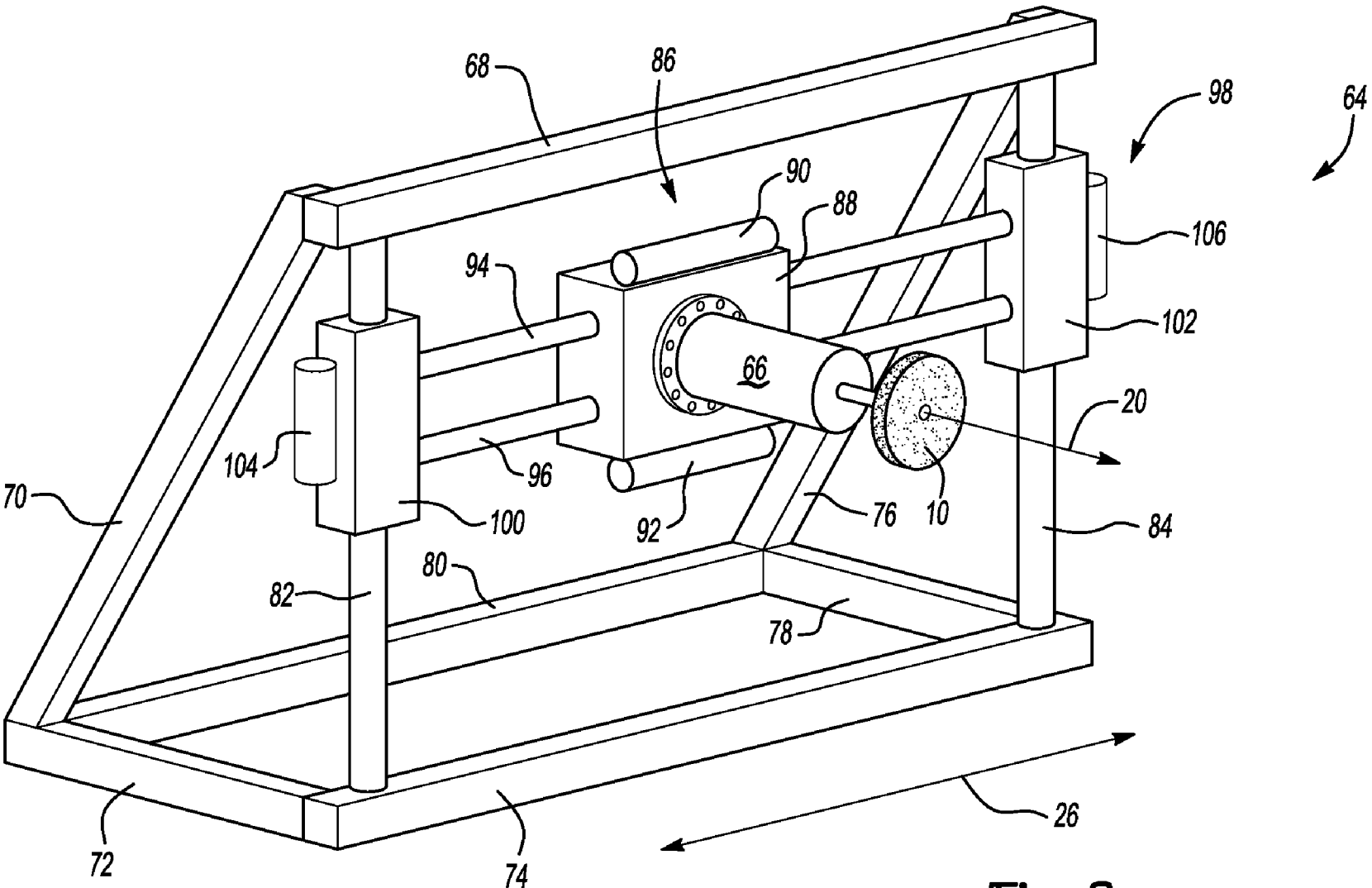
FIG. 8 is a perspective view of an exemplary apparatus for practicing the first and second embodiments of the invention.

The invention also contemplates an apparatus for grinding a feature in a work-piece. An embodiment of the apparatus is shown schematically in FIG. 8. The apparatus 64 includes a rotating device 66 operable to rotate the grinding wheel 10 about the first axis 20. The exemplary apparatus 64 includes frame members 68, 70, 72, 74, 76, 78, 80 and tubular members 82, 84 engaged to one another to form a frame for supporting the rotating device 64 during movement.

The apparatus 64 also includes a first moving device 86 operable to traverse the rotating device 66 and a work-piece relative to one another along the second axis 26 that is transverse to the first axis 20 to form a feature in the work-piece. The exemplary first moving device 86 moves the rotating device 64. In alternative embodiments of the invention, the first moving device can move the work-piece. The first moving device 86 includes a carriage 88 and motors 90, 92. The carriage 88 defines apertures that encircle tubular members 94, 96, which will be described in greater detail below. The rotating device 66 is mounted on the carriage 88. The carriage 88 houses moving structures (not shown), such as friction wheels or gears, that engage the tubular member 94, 96. The motors 90, 92 are coupled to the moving structures to drive the carriage 88 along the tubular members 94, 96.

The apparatus 64 also includes a second moving device 98 operable to oscillate the rotating device 66 and the work-piece toward and away from one another in first and second opposite directions transverse to both of the first and second axes 20, 26. The exemplary second moving device 98 moves the rotating device 64. In alternative embodiments of the invention, the second moving device can move the work-piece. The second moving device 98 includes a carriage 100 having an aperture receiving the tubular member 82 and a carriage 102 having an aperture receiving the tubular member 84. The tubular members 94 and 96 extend between the carriages 100, 102. The second moving device 98 also includes a motor 104 mounted on the carriage 100 and a motor 106 mounted on the carriage 102. The carriages 100, 102 each house moving structures (not shown), such as friction wheels or gears, that engage the tubular member 82, 84, respectively. The motors 104, 106 are coupled to the moving structures housed in the carriages 100, 102, respectively, to drive the carriages 100, 102 along the tubular members 82, 84.

The first and second moving devices 86, 98 are operable to cooperate with one another such that the rotating device 66 and the work-piece are concurrently movable relative to one another along both the second axis 26 and at least one of the first and second opposite directions to reduce burning of the work-piece. The moving devices 86, 98 can be controlled by a common controller. The apparatus 64 shown in the figures is exemplary and the invention can be practiced with other apparatus that are constructed differently and operate differently. For example, the first and second moving devices may be integral, such as in the form of a robotic arm.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for grinding a feature in a work-piece:

rotating a grinding wheel about a first axis;

traversing the rotating grinding wheel and a work-piece relative to one another along a second axis that is transverse to the first axis to form a feature in the work-piece; and oscillating the rotating grinding wheel and the work-piece toward and away from one another in first and second opposite directions transverse to both of the first and second axes during said traversing step such that the rotating grinding wheel and the work-piece are moving relative to one another along both of the second axis and one of the first and second opposite directions during said traversing step to reduce burning of the work-piece, and wherein a rate of material removal from the work-piece increases in one of said first and second opposite directions and decreases in the other of said first and second opposite directions.

2. The method of claim 1 wherein said oscillating step further comprises the step of:

moving the grinding wheel in the first and second opposite directions along a path that is perpendicular to only one of the first and second axes.

3. The method of claim 1 wherein said oscillating step further comprises the step of:

moving the grinding wheel in the first and second opposite directions along a path that is perpendicular to both of the first and second axes.

4. The method of claim 1 wherein said traversing step further comprises the steps of:

moving one of the rotating grinding wheel and the work-piece; and maintaining the other of the rotating grinding wheel and the work-piece stationary during said moving step.

5. The method of claim 1 wherein said oscillating step includes the step of:

varying a speed of movement transverse to the first and second axes during said oscillating step.

6. The method of claim 1 wherein said oscillating step includes the step of:

moving the rotating grinding wheel and the work-piece relative to one another at different speeds in each of the first and second opposite directions.

7. The method of claim 1 wherein said oscillating step includes the steps of:

separating the rotating grinding wheel and the work-piece from one another in the first direction at a first speed; and bringing the rotating grinding wheel and the work-piece together in the second direction at a second speed less than the first speed.

8. The method of claim 1 wherein said oscillating step is further defined as:

moving the first axis in a saw-tooth pattern in a plane that contains the second axis and is perpendicular to the first axis.

9. The method of claim 8 wherein said moving step includes the step of:

defining the saw-tooth pattern of movement with a series of asymmetrical teeth shapes such that the first axis moves along a first slope in the first direction and a second slope in the second direction wherein the first slope is different from the second slope.

10. The method of claim 9 wherein said defining step includes the steps of:

increasing a distance between the first axis and the second axis during movement of the grinding wheel along the second axis at a positive slope having a value of at least 2; and decreasing the distance between the first axis and the second axis during movement of the grinding wheel along the second axis at a negative slope having an absolute value of at least 0.333.

11. The method of claim 8 wherein said moving step includes the step of:

defining the saw-tooth pattern of movement with a series of symmetrical teeth shapes such that the first axis moves along a first slope in the first direction and a second slope in the second direction wherein the first slope is equal to the second slope.

12. The method of claim 11 wherein said defining step includes the steps of:

increasing a distance between the first axis and the second axis during movement of the grinding wheel along the second axis at a positive slope having a value of at least 0.667; and decreasing the distance between the first axis and the second axis during movement of the grinding wheel along the second axis at a negative slope having an absolute value of at least 0.667.

13. The method of claim 1 further comprising the step of:

moving the rotating grinding wheel and the work-piece relative to one another to return the rotating grinding wheel back through the formed feature at a constant vertical position and in a direction opposite of a direction of movement during said traversing step to minimize variation in a depth of the feature.

14. The method of claim 13 wherein said moving step is further defined as:

moving the rotating grinding wheel faster during the return movement than initial movement occurring during said traversing step.

15. An apparatus for grinding a feature in a work-piece:

a rotating device operable to rotate a grinding wheel about a first axis;

a first moving device operable to traverse said rotating device and a work-piece relative to one another along a second axis that is transverse to said first axis to form a feature in the work-piece; and a second moving device operable to oscillate said rotating device and the work-piece toward and away from one another in first and second opposite directions transverse to both of said first and second axes, wherein said first and second moving devices are operable to cooperate with one another such that said rotating device and the work-piece are concurrently movable relative to one another along both said second axis and at least one of said first and second opposite directions to reduce burning of the work-piece, and wherein a rate of material removal from the work-piece increases in one of said first and second opposite directions and decreases in the other of said first and second opposite directions.

16. The apparatus of claim 15 further comprising:

a grinding wheel engageable with said rotating device and having at least one tapered wall.

17. The apparatus of claim 16 wherein said grinding wheel is further defined as having at two tapered walls.

18. The apparatus of claim 15 wherein said first moving device is further defined as being operable to move said rotating device.

19. The apparatus of claim 18 wherein said second moving device is further defined as being operable to move said rotating device.

20. The apparatus of claim 19 further comprising:

a controller controlling both of said first and second moving devices.

* * * * *